US009844689B2

(12) United States Patent
LaRue

(10) Patent No.: US 9,844,689 B2
(45) Date of Patent: Dec. 19, 2017

(54) SAFETY RESTRAINT SYSTEM FOR AN ELEVATED WORKER'S BUCKET

(71) Applicant: Buckingham Manufacturing Company, Inc., Binghamton, NY (US)

(72) Inventor: Robert LaRue, Binghamton, NY (US)

(73) Assignee: BUCKINGHAM MANUFACTURING COMPANY, INC., Binghamton, NY (US)

( * ) Notice: Subject to any disclaimer, the term of this patent is extended or adjusted under 35 U.S.C. 154(b) by 0 days.

(21) Appl. No.: 14/698,032

(22) Filed: Apr. 28, 2015

(65) Prior Publication Data

US 2015/0314150 A1 Nov. 5, 2015

Related U.S. Application Data

(60) Provisional application No. 61/985,194, filed on Apr. 28, 2014.

(51) Int. Cl.
*A62B 35/00* (2006.01)
*B66F 17/00* (2006.01)

(52) U.S. Cl.
CPC ..... *A62B 35/0068* (2013.01); *A62B 35/0018* (2013.01); *A62B 35/0075* (2013.01); *B66F 17/006* (2013.01)

(58) Field of Classification Search
CPC ..... A62B 35/0037; A62B 35/0068
See application file for complete search history.

(56) References Cited

U.S. PATENT DOCUMENTS 4,130,176 A * 12/1978 Paulie ..... A62B 35/0093 182/191
4,407,392 A 10/1983 Lazzari
4,951,778 A * 8/1990 Halvorson ..... A01M 31/02 182/9
5,279,385 A * 1/1994 Riches ..... A62B 35/0087 182/3
5,531,292 A * 7/1996 Bell ..... A62B 35/0037 182/3
6,125,966 A * 10/2000 Jones ..... A62B 35/0018 182/3
6,330,931 B1 * 12/2001 Baillargeon ..... A62B 35/0037 182/18
6,520,290 B1 * 2/2003 Carter ..... A62B 35/0037 182/3
6,823,964 B2 * 11/2004 Goode ..... A62B 1/22 182/113
8,899,380 B2 * 12/2014 Chard ..... B66F 17/006 182/129
2015/0027808 A1 * 1/2015 Baillargeon ..... B66F 17/006 182/3

* cited by examiner

*Primary Examiner* — Alvin Chin-Shue
(74) *Attorney, Agent, or Firm* — Bond Schoeneck & King, PLLC; Frederick Price; George McGuire

(57) ABSTRACT

A safety restraint system for use by a worker working in a bucket, including a primary tether line that securely encircles the bucket at a position adjacent to the upper rim thereof; at least a pair of straps connected to the tether line on opposite sides of the bucket; a safety harness or aerial belt adapted to be worn by the worker and having at least a pair of clips attached thereto; and at least a pair of straps that interconnect the harness buckles to the straps on the tether line, thereby interconnecting the harness to the tether line.

1 Claim, 4 Drawing Sheets

SAFETY RESTRAINT SYSTEM FOR AN ELEVATED WORKER'S BUCKET

REFERENCE TO RELATED APPLICATION

This application relates and claims priority to U.S. provisional application Ser. No. 61/985,194 filed Apr. 28, 2014, the entirety of which is hereby incorporated by reference.

BACKGROUND

1. Field of Invention

The present invention relates generally to safety devices for bucket trucks, and more particularly to restraints that assist in preventing a worker from falling from an elevated bucket.

2. Background of Art

Bucket trucks are commonly used by utility workers when repairing or performing maintenance on utility poles, lines, and equipment. Such trucks could also be used by arborists, firemen, construction, and other workers having a need to be elevated and remain relatively mobile while elevated. These types of workers often have a need to extend their reach well beyond the confines of the bucket and such reaching may lead to the worker falling over the edge of the bucket. Such a fall can lead to serious injury or quite possibly death.

3. Objects and Advantages

It is therefore a principal object of the present invention to provide a restraint system that prevents a worker from exceeding a minimal fall distance into a hazard fall zone or from inadvertently exiting the basket of the bucket truck all together.

Other objects and advantages of the present invention will in part be obvious and in part appear hereinafter.

SUMMARY OF THE INVENTION

In accordance with these objects and advantages, the present invention provides a safety restraint system for use by a worker working in a bucket, comprising a primary tether line that securely encircles the bucket at a position adjacent to the upper rim thereof; either a single strap connected to the tether line or a pair of straps connected to the tether line on opposite sides of the bucket; a safety harness (or aerial belt) adapted to be worn by the worker and having a single or a pair of clips attached thereto; a single strap or a pair of straps that interconnect the harness buckles to the straps on the tether line, thereby interconnecting the harness to the tether line. In addition, a secondary tether line interconnects the primary tether line to the basket boom anchor which will protect the worker in the event the bucket itself disengages from the boom. The harness comprises a pair of shoulder straps with adjustable buckles, a strap that connects the two shoulder straps and is positioned to extend across the worker's chest and a waist belt that also connects to the shoulder straps and extends around the worker's waist. Buckles and straps securely interconnect the harness to the tether line. In use, a strap interconnects the harness to the tether line on opposite sides of the bucket. Thus, if the worker were to fall from the bucket, the downward force created by his fall would result in an upward force applied to the strap on the opposite side of the bucket. When an upward force is applied to the strap it rides on the bucket's exterior surface but is prevented from disengaging from the bucket due to the bucket's flanged rim. Therefore, the worker will not fall into a hazard zone or will not even fall from the bucket.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
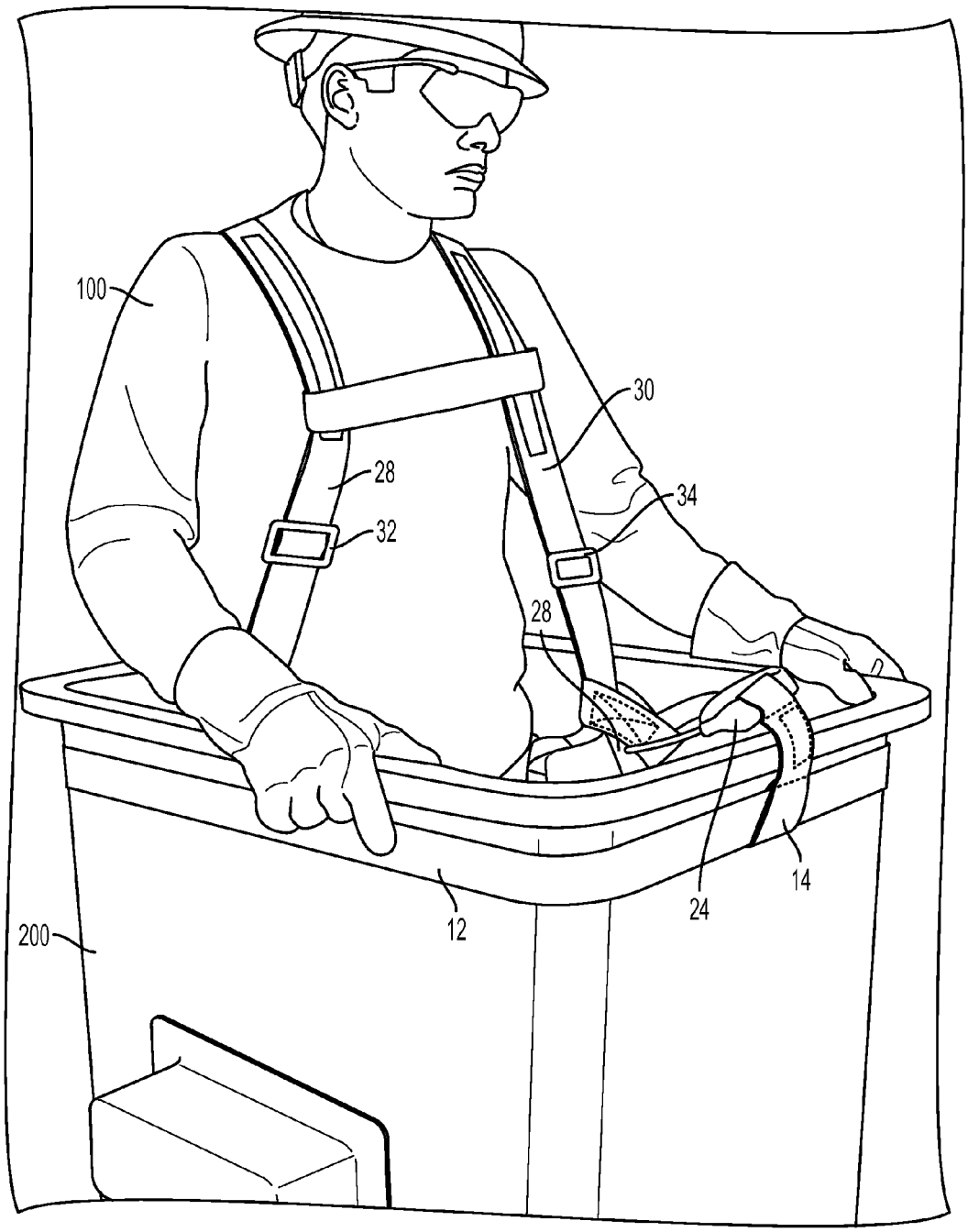
FIG. 1 is front perspective view of an embodiment of the present invention with a worker standing in a bucket.

Referring to the drawings, in which like reference numerals refer to like parts throughout, there is seen a safety restraint system, designated generally by reference numeral 10, for use by a worker 100 working from a conventional bucket 200. Safety restraint system 10 is intended to be worn by worker 100 to prevent the worker from falling out of the bucket 200 and falling to the ground.

Safety restraint system 10 generally comprises a primary tether line 12 that encircles and is securely fastened to bucket 200, a pair of straps 14, 16 that connect to primary tether line 12 via straps and/or buckles 18, 20, and a body harness, designated generally by reference numeral 22, adapted to be worn by worker 100 and to which the opposite end of straps 14, 16 connect via straps and/or buckles 24, 26. In a multi-person bucket, there would be double the number of connectors/attachment points. Straps 14 and 16 are movable relative to primary tether line 12 as the straps interconnecting them can be slid along the primary tether line, thus permitting repositioning of the straps as necessary for the worker to do his work and remain safe. With system 10, worker 100 is tethered to bucket 200 by way of the harness 22, straps 14, 16, and primary tether line 12, and in the event of an accidental fall from bucket 200, worker 100 will be prevented from falling to the ground and will be suspended from the bucket 200 by way of the safety restraint system 10.

Body harness 22 comprises a pair of shoulder straps 28, 30 with adjustment buckles 32, 34 to permit their length to be selectively adjusted, a strap 36 that gathers the shoulder straps 28, 30 and prevents them from sliding off the worker's shoulders, and a waist 38 that is connected to the shoulder straps 28, 30 and extends around the worker's waist. A series of straps/O-rings/D-clips (collectively referred to as "fasteners") 40 are integrated into the harness 22 at various positions to permit the connection of the harness to the straps 14, 16.

Primary tether line 12 wraps around bucket 200 and is tightly fastened at a position just below the flanged rim 202 of bucket 200. As flanged rim 202 is of a peripheral dimension greater than the peripheral dimension of the rest of the exterior surface of bucket 200, primary tether line cannot ride up the exterior of bucket 200 beyond the rim 202. Moreover, the flange that forms the flanged rim 202 further serves as a stop or catch for the primary tether line 12 if it were to ride all the way up to the top of the bucket's exterior surface, thus preventing it from becoming detached from the bucket 200. In buckets without rims, placement of the primary tether beneath the boom attachment point will also serve to prevent it from becoming disengaged from the bucket.

Figure 2:
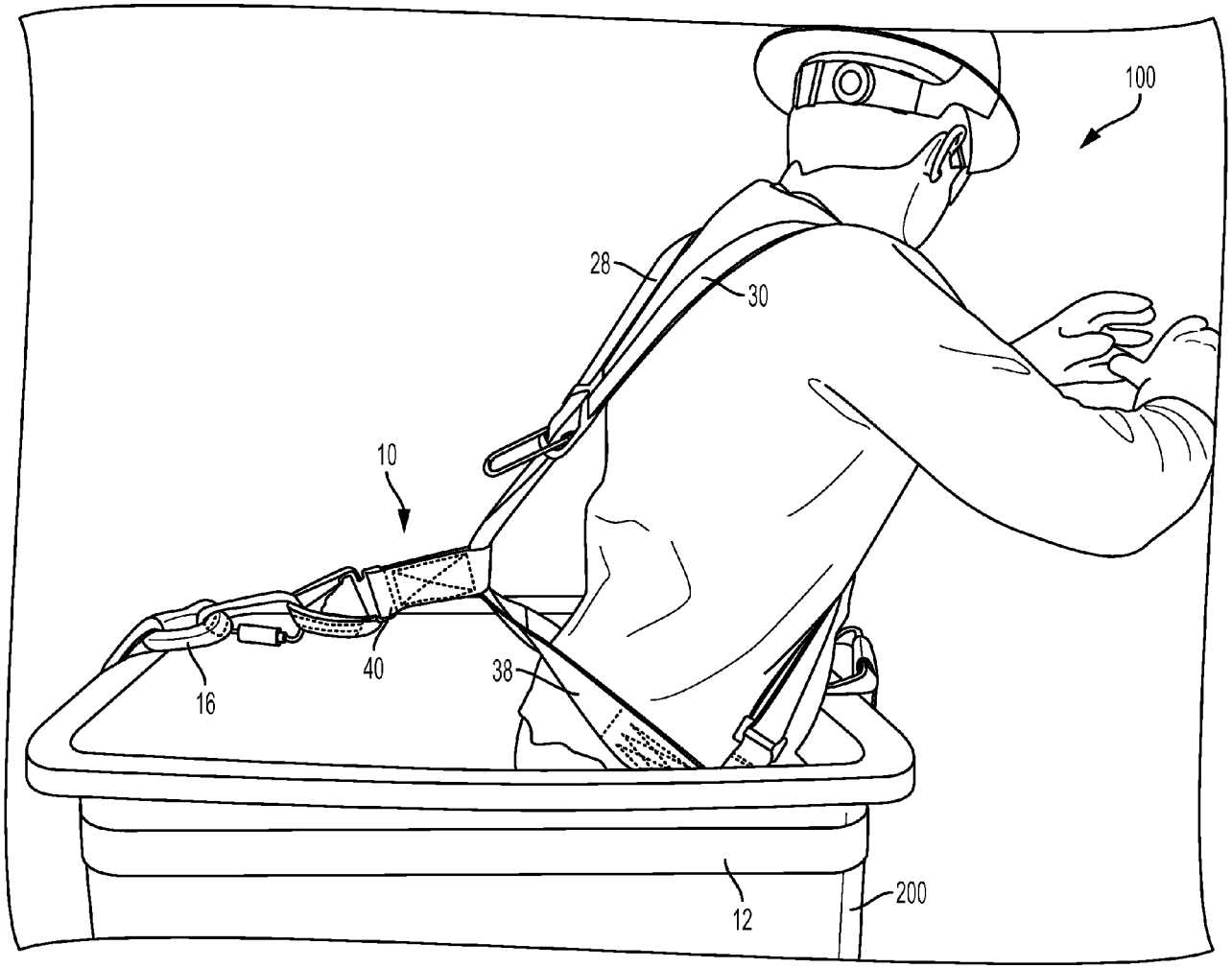
FIG. 2 is a side elevation view of the present invention with a worker leaning forward from the bucket.

Referring to FIGS. 1 and 2, when a worker 100 is standing in the bucket 200 (FIG. 1) or is leaning forward from the bucket (FIG. 2), straps 14, 16 are anchored to primary tether line 12 at the front and rear of bucket 200. By having the straps 14, 16 extend from the front and rear of harness 22 to primary tether line 12, if worker 100 were to accidentally fall from the front of bucket 200, as could happen when leaning forward as seen in FIG. 2, an upwardly directed force will be applied to the rear strap 16 while a downwardly extending force will be applied to the front strap 14. The combination of these forces will cause the worker 100 to simply remain suspended from bucket 200 until he can either climb back into the bucket or until help arrives.

Figure 3:
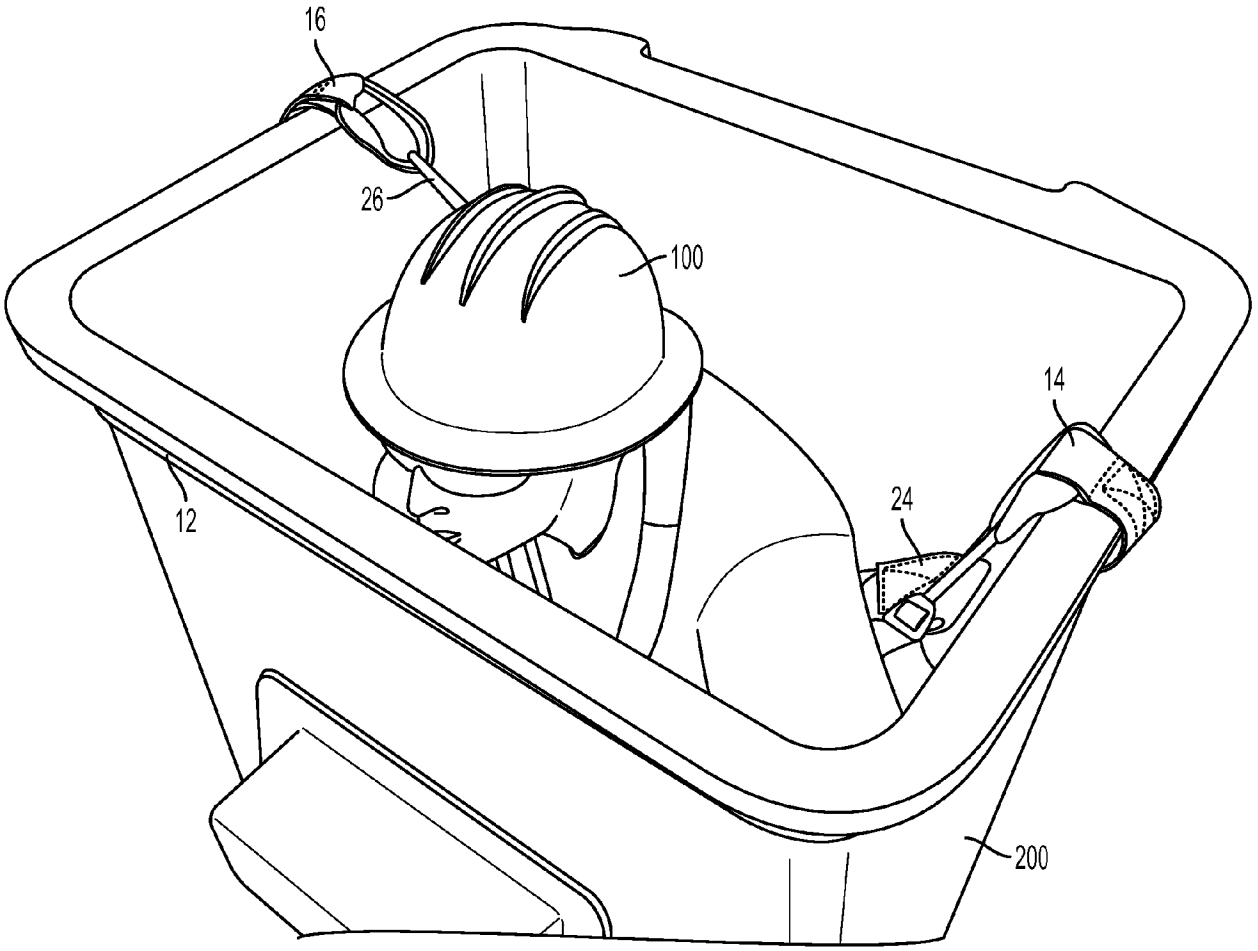
FIG. 3 is an upper perspective view of the present invention with a worker squatted down within the bucket.

Likewise, when the worker 100 is squatting within the bucket 200 as seen in FIG. 3, the straps 14 and 16 are slid front the front and rear of bucket 200 to the opposite sides bucket. This keeps the straps out of the face of the worker 100, thus not creating any distraction, while still maintaining the safety of having straps 14, 16 on opposite sides of the bucket 200.

Figure 4:
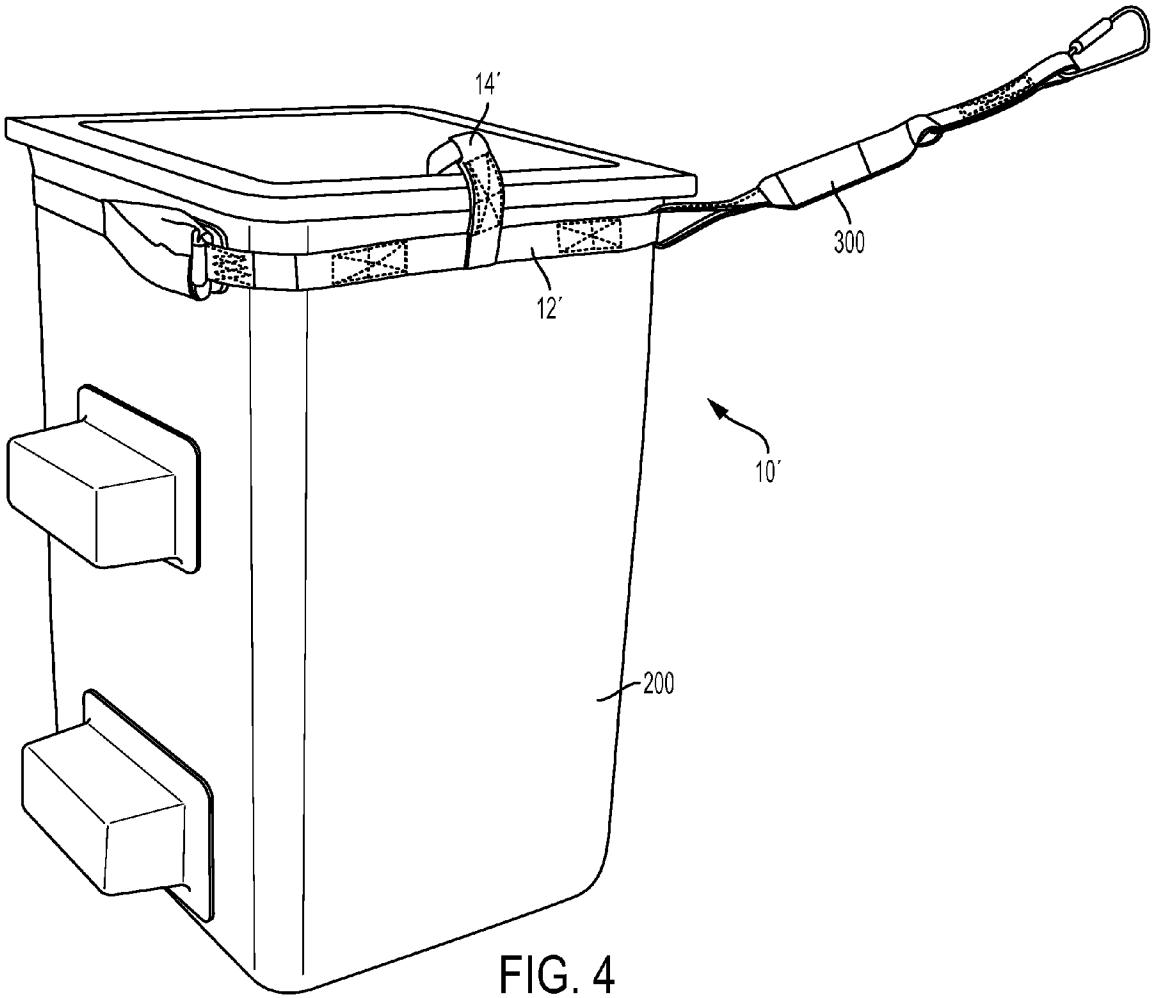
FIG. 4 is a perspective view of an alternate embodiment of the present invention.

With reference to FIG. 4, an alternate embodiment of safety restraint system 10, designated 10', is provided. Safety restraint system 10' includes primary tether line 12' to which a single strap 14' is attached and which is adapted to attach to a buckle on the worker's harness (not shown in FIG. 4). This single strap 14' in system 10' will prevent worker (not shown in FIG. 4) from falling the beyond distance equal to the length of the strap (e.g., 2 feet) if he/she inadvertently falls from the bucket. Thus, unlike system 10, where worker 100 will be prevented from even falling out of bucket 200, system 10' will prevent the worker from falling beyond some minimal distance from bucket 200, but will not necessarily prevent the worker from not falling out of the bucket all together.

Also shown in FIG. 4, and a feature that could also be included in system 10, is a secondary tether 300 that extends between the primary tether 10 (or 10') and the conventional boom anchor to which the basket of bucket 200 attaches. In the event the basket disengages from the boom, secondary tether 300 will prevent the basket from falling to the ground. In addition, safety restraint system 10 (or 10') will prevent the worker from falling too far beyond the basket even if it disengages from the boom.

What is claimed is:

1. A safety restraint system, comprising:

a. bucket having a body terminating in a mouth defining a flanged rim having a peripheral diameter;

b. a primary tether line placed in an encircling relation on the bucket below the flanged rim and including a first and second end, the first end being fastened to the second end such that the primary tether forms a loop, wherein said primary tether line is dimensioned to have a diameter less than the peripheral diameter of the flanged rim of said bucket, the primary tether line is prohibited from passing over the flanged rim of said bucket such that said primary tether line is retained on said bucket without anchors;

b. a body harness adapted to be worn by the worker; and c. first and second straps interconnecting said harness to said primary tether line, wherein said first and second straps are selectively movable relative to and along a major portion of said primary tether line, wherein the first and second straps are sized to prevent the worker wearing the harness from bodily exiting the bucket and to prevent the primary tether from passing over the bottom of the bucket when the first and second straps are attached to the primary tether, wherein the first and second straps are positioned to attach on the opposite sides of the bucket.

* * * * *